US005306364A

United States Patent [19]

Hong et al.

[11] Patent Number: 5,306,364

[45] Date of Patent: Apr. 26, 1994

[54] HIGH TOUGHNESS TUNGSTEN BASED HEAVY ALLOY CONTAINING LA AND CA. MANUFACTURING THEREOF

[75] Inventors: Seong-Hyeon Hong; Suk-Joong L. Kang; Duk Yong Yoon, all of Seoul; Woon-Hyung Baek, Daejon, all of Rep. of Korea

[73] Assignee: Agency For Defense Development, Daejon, Rep. of Korea

[21] Appl. No.: 896,134

[22] Filed: Jun. 9, 1992

[51] Int. Cl.[5] ..... B22F 1/00; C22C 27/00

[52] U.S. Cl. ..... 148/673; 420/430

[58] Field of Search ..... 420/430; 148/673

[56] References Cited

U.S. PATENT DOCUMENTS 3,138,453 6/1964 Foster, Jr. et al. ..... 420/430
3,150,971 9/1964 Weisert et al. ..... 420/430
3,888,636 6/1975 Sczerzenie et al. ..... 420/430
3,988,118 10/1976 Grierson et al. ..... 420/430
4,784,690 11/1988 Mullendore ..... 420/430
4,990,195 2/1991 Spencer et al. ..... 420/430
5,028,756 7/1991 Ezaki et al. ..... 420/430

*Primary Examiner*—Upendra Roy
*Attorney, Agent, or Firm*—Scully, Scott, Murphy & Presser

[57] ABSTRACT

A tungsten based heavy alloy having a W—Ni—Fe based composition containing traces of lanthanum or calcium, thereby capable of exhibiting high toughness, irrespective of the content of impurities such as phosphorous and sulfur contained therein, the cooling rate after the sintering treatment and the re-heating treatment. The present invention provides a method for making the high toughness tungsten based heavy alloy. The tungsten based heavy alloy of the present invention is useful to manufacture warheads for breaking armor plates, which require high toughness.

4 Claims, 2 Drawing Sheets

HIGH TOUGHNESS TUNGSTEN BASED HEAVY ALLOY CONTAINING LA AND CA. MANUFACTURING THEREOF

BACKGROUND OF THE INVENTION

1. Field of the Invention

The present invention relates to a tungsten based heavy alloy, and more particularly to a tungsten based heavy alloy having a W—Ni—Fe based composition containing traces of lanthanum or calcium, thereby capable of exhibiting the high toughness, irrespective of the content of impurities such as phosphorous and sulfur contained therein, the cooling rate after the sintering treatment and the re-heating treatment, and a method for manufacturing thereof.

2. Description of the Prior Art

Generally, such a tungsten based alloy consists of about 90% tungsten and the balance nickel and iron(-copper). Since tungsten is a metal having a high melting point, the tungsten based alloy is produced by using a liquid sintering process which is one of powder metallurgies.

Tungsten based heavy alloys are widely used in various technical fields, to produce weights of gyroscopes, balanced supports of aircraft, containers for containing radioactive materials, vibration attenuators, warheads for breaking armor plates, and etc.

In terms of the mechanical properties, such tungsten based heavy alloys have relatively superior strength and elongation, to other alloys. However, toughness of tungsten based heavy alloys may vary greatly, depending upon the used manufacturing process and the used powder. In particular, heavy alloys made of a powder in which impurities such as phosphorous and sulfur were insufficiently removed during the manufacturing processes exhibit deteriorated mechanical properties involving toughness. As a result, such heavy alloys can not be used in manufacturing products requiring high mechanical properties, such as warheads for breaking armor plates.

It has been known that the deterioration of the mechanical property of heavy alloys due to the impurities was caused by the boundary segregation of the impurities. Accordingly, there have been researches for avoiding the boundary segregation of impurities presented in heavy alloys, in order to prevent the mechanical properties of heavy alloys from being deteriorated.

For example, a method for avoiding the boundary segregation of impurities has been known, which utilized the fact that the boundary segregation of impurities is reduced as the heat treatment temperature of heavy alloy increases. The method can be mainly applied to a heavy alloy containing impurities at a small amount of several hundred ppm and comprises water-cooling the heavy alloy at a high temperature of about 1,000° C., so as to avoid the boundary segregation and thus the deterioration of toughness.

It is also known that as the alloy is subjected to an aging at a temperature of about 500° C. to 600° C., as a subsequent heat treatment, the mechanical property of the treated alloy is improved. However, this aging treatment causes the displacement of impurities dispersed in the alloy structure to crystalline boundaries of the structure, thereby resulting in the boundary segregation of the impurities. Consequently, the problem of the boundary segregation of the impurities occurs again. Thus, it is difficult to improve the mechanical property of heavy alloys, by using the water cooling at a high temperature and the aging treatment at a low temperature.

For producing a heavy alloy having high toughness, therefore, it is necessary to provide a heavy alloy of a new type which has a composition capable of improving the mechanical property irrespective of the substantial content of impurities and the heat treatment.

SUMMARY OF THE INVENTION

Therefore, it is an object of the invention to provide a tungsten based heavy alloy having a novel composition capable of exhibiting high toughness, irrespective of the content of impurities such as phosphorous and sulfur contained therein, the cooling rate and the re-heating treatment, and a method for manufacturing thereof.

In one aspect, the present invention provides a high toughness tungsten based heavy alloy consisting of a W—Ni—Fe based composition containing tungsten of at least 90 wt %, wherein lanthanum of 0.01 wt % to 1.0 wt % is contained in the composition.

In another aspect, the present invention provides a high toughness tungsten based heavy alloy consisting of a W—Ni—Fe based composition containing tungsten of at least 90 wt %, wherein calcium of 0.01 wt % to 0.3 wt % is contained in the composition.

In another aspect, the present invention provides a method for manufacturing a high toughness tungsten based heavy alloy, comprising the steps of: preparing an alloy having the composition of claim 2, by forming a preform obtained from raw powder which being subjected to a mixing, a drying, a milling and a shaping, and sintering the preform for 60 minutes to 100 minutes in a hydrogen atmosphere of 1,475° C.; heat treating the alloy for an hour in an inert atmosphere of 1,150° C.; water cooling the heat treated alloy; and aging the alloy for an hour in an inert atmosphere of 500° C. to 600° C.

BRIEF DESCRIPTION OF THE DRAWINGS

Other objects and aspects of the invention will become apparent from the following description of embodiments with reference to the accompanying drawings in which:

FIGS. 1A and 1B are scanning electron microscopic photographs of W—Ni—Fe based heavy alloys, in which FIG. 1A shows a fracture of the conventional heavy alloy sample, while FIG. 1B shows a fracture of the heavy alloy sample of the present invention.

DESCRIPTION OF THE PREFERRED EMBODIMENTS

Figure 1A:
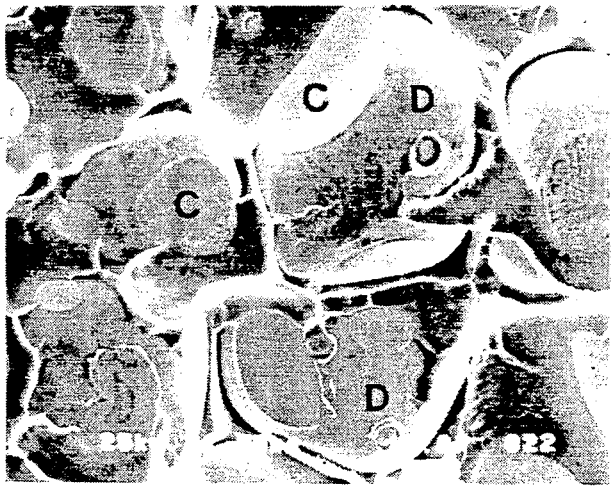
FIG. 1A PRIOR ART

A high toughness tungsten based heavy alloy according to the present invention has a W—Ni—Fe based composition consisting of at least about 90 wt % tungsten, no more than about 10 wt % nickel and iron, and the traces lanthanum or calcium.

The traces of lanthanum and calcium which are contained in the heavy alloy of the present invention are elements reacting readily with phosphorous and sulfur which are the impurity functioning to as the cause of deteriorating the toughness of the heavy alloy. The lanthanum and calcium form lanthanum and calcium compounds with their matrixes containing phosphorous and sulfur, respectively. The produced compounds function to restrict the displacement of impurities to crystalline boundaries and thus the boundary segregation of the impurities, thereby improving the toughness of the alloy.

A typical heavy alloy of the present invention has a 93 wt % W—4.9 wt % Ni—2.1 wt % Fe based composition in which a part of tungsten is substituted by lanthanum or calcium. Respective amounts of substituted lanthanum and calcium are preferably about 0.1 wt % to 0.3 wt % and 0.01 wt % to 0.05 wt %.

The limitation in contents of lanthanum and calcium is based on the following reason.

At the amount of less than 0.1 wt %, lanthanum can not restrict sufficiently the boundary segregation of the impurities, namely, phosphorous and sulfur. On the other hand, lanthanum in exceeding 0.3 wt % forms excessive inclusions which causes the deterioration of tensile property.

In similar to lanthanum, calcium of less than 0.01 wt % is insufficient to form a calcium compound in an amount for avoiding the boundary segregation of phosphorous and sulfur. In exceeding 0.05 wt %, calcium forms excessive inclusions which cause the deterioration of tensile property.

On the other hand, if contents of nickel and iron vary within their ranges(within about 10 wt %) allowing the properties of the tungsten based heavy alloy to be still maintained or if the content of the impurities varies, lanthanum and calcium which are added as trace elements to the heavy alloy may also vary more or less, in similar to additives contained in general type alloys.

Now, a method for manufacturing the heavy alloy according to the present invention will be described.

First, lanthanum or calcium is added to and wet mixed with a W—Ni—Fe powder mixture in which respective contents of ingredients are measured to provide a tungsten based heavy alloy. The obtained mixture is subjected to a dry process and a shaping process, and then to a preliminary sintering process which is carried out in a tube type furnace and in a hydrogen atmosphere. The preliminary sintered material is then sintered in a hydrogen atmosphere of about 1,475° C., for about 60 minutes to about 100 minutes. Thereafter, the sintered material is heat treated in an inert atmosphere of about 1,150° C. and then water cooled. Finally, the sintered material is heat treated again in an inert atmosphere of about 500° C. to about 600° C., so as to obtain a high toughness tungsten based heavy alloy according to the present invention.

The produced high toughness tungsten based heavy alloy exhibits high and uniform toughness, irrespective of the content of impurities contained in the raw powder, the cooling rate in the manufacture, and the reheating treatment, by virtue of the fact that lanthanum or calcium functions to avoid the boundary segregation of impurities such as phosphorous and sulfur.

The present invention will be understood more readily with reference to the following examples; however these examples are intended to illustrate the invention and are not to be construed to limit the scope of the present invention.

EXAMPLE 1

Lanthanum dissolved in a distilled water to form $LaCl_3 7H_2O$ was added to and wet mixed with each of various W—Ni—Fe powder mixtures, in an amount allowing lanthanum to remain within the range maintaining the properties of a tungsten based heavy alloy to be produced. The W—Ni—Fe powder mixtures were of two tungsten based heavy alloy composition types one of which contains phosphorous in a large amount of about 150 ppm, the other containing sulfur of 200 ppm.

In order to produce another sample, calcium having the form of $Ca(NO_3)_2 4H_2O$ (calcium nitrate) dissolved in ethyl alcohol was added to and wet mixed with each of various W—Ni—Fe powder mixtures, in an amount allowing calcium to remain within the range maintaining the properties of a tungsten based heavy alloy to be produced. The W—Ni—Fe powder mixtures had different sulfur contents ranging from 50 ppm to 200 ppm.

Thereafter, each obtained mixture was subjected to a dry process which was carried out for four hours in an oven heated to about 70° C., so as to evaporate the distilled water. The mixture was then sufficiently milled. The milled powder was subjected to a compacting process under a pressure of 100 MPa, so as to be shaped into an impact test sample or a tensile test sample. Subsequently, the produced compact was subjected to a preliminary sintering process. The preliminary sintering process was carried out for one hour and thirty minutes after heating the compact to about 950° C. at a constant rate of about 45° C. to about 50° C. and in a tube type furnace of a hydrogen atmosphere, and then also carried out for thirty minutes at 1,200° C.

Then, the preliminarily sintered sample was sintered in a hydrogen atmosphere of about 1,475°, for about 60 minutes to about 100 minutes. The cooling time at the sintering temperature was about 60 minutes. Thereafter, the sintered sample was heat treated in an inert atmosphere, such as nitrogen or argon, at about 1,150° C. and for one hour, and then water cooled. The finally obtained impact test sample was machined to have no notch and the size of 7.5 mm × 7.5 mm × 32 mm and then subjected to a Charpy impact test.

After the tensile test or the impact test, the fracture of the samples was observed. Thereafter, the composition at the boundary in each sample was analyzed by utilizing a Auger electron spectroscopy.

The measured tensile property and the impact property in each sample was described in TABLES 1 and 2.

TABLE 1

(Mechanical Properties in Cases of containing phosphorous of 150 ppm)

| samples | composition (wt %) | Mechanical Properties: Tensile Strength (MPa) | Elongation (%) | Impact Energy (Joules) |
|---|---|---|---|---|
| A1 | 92.9 W - 4.9 Ni - 2.1 Fe - 0.1 La | 852 (±15) | 17.0 (±2.2) | 23.0 (±6.8) |
| A2 | 92.7 W - 4.9 Ni - 2.1 Fe - 0.3 La | 850 (±7) | 17.0 (±2.2) | 28.5 (±6.8) |
| B1 | 93 W - 4.9 Ni - 2.1 Fe | 856 (±15) | 20.0 (±2.0) | 5.4 (±2.7) |

TABLE 2

(Mechanical Properties in Cases of containing sulfur of 50 to 200 ppm)

| samples | composition (wt %) | Mechanical Properties: Tensile Strength (MPa) | Elongation (%) | Impact Energy |
|---|---|---|---|---|
| A3 | 92.9 W - 4.9 Ni - 2.1 Fe - 0.01 Ca (containing 50 ppm S) | 854 (±15) | 20.0 (±2) | 30.0 (±4.0) |
| B2 | 93 W - 4.9 Ni - 2.1 Fe (containing 50 ppm S) | 856 (±15) | 20.0 (±2) | 6.8 (±2.7) |
| A4 | 92.96 W - 4.9 Ni - 2.1 Fe - 0.04 Ca (containing 50 ppm S) | 854 (±14) | 20.0 (±3) | 28.0 (±7.0) |
| A5 | 92.7 W - 4.9 Ni - 2.1 F3 - 0.3 La containing 200 ppm S) | 850 (±8) | 17.0 (±2.0) | 24.5 (±6.5) |
| B3 | 93 W - 4.9 Ni - 2.1 Fe (containing 200 ppm S) | 853 (±15) | 20.0 (±3) | 5.4 (±2) |

In TABLES 1 and 2, samples A1 to A5 are heavy alloys in accordance with the present invention, while samples B1 to B3 are conventional heavy alloys for comparing to the heavy alloys of the present invention.

Although being subjected to a water cooling which were conventionally carried out at a heat treatment temperature predetermined for avoiding the boundary segregation, the case of containing phosphrous in a large amount, for example 150 ppm, as in the sample B1, exhibited very low impact energy. However, samples of the present invention which contained lanthanum of 0.1 wt % or 0.3 wt % exhibited slightly reduced tensile property, but abruptly increased impact energy.

Figure 1B:
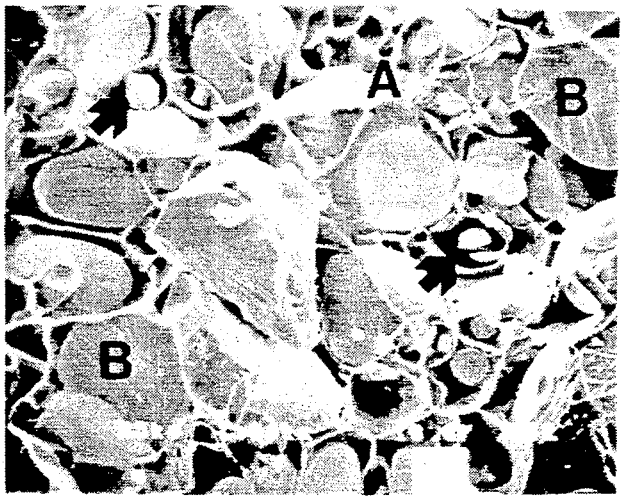

On the other hand, FIGS. 1A and 1B are scanning electron microscopic photographs, in which FIG. 1A shows a fracture of the sample B1, while FIG. 1B shows a fracture of the sample A2.

As shown in FIG. 1A, the sample B1 which contained phosphorous of 150 ppm exhibited a boundary brittleness and thus the reduced impact property, even though being subjected to a water cooling at a high temperature. This is because phosphorous were segregated at the boundaries between adjacent tungsten grains and between tungsten grains and the matrix and exhibited a boundary brittleness.

This phenomena are apparent from the photograph of FIG. 1A. That is, the areas C and D correspond to those exhibited the boundary brittleness between tungsten grains and the boundary brittleness between tungsten grains and the matrix, respectively.

On the other hand, the sample A2 which contained phosphorous of 150 ppm and lanthanum of 0.3 wt % in accordance with the present invention exhibited an intercrystalline rupture which occurred in the form of a typical softness rupture. As a result, increased impact properties were exhibited. This is because the segregation of phosphorous was inhibited, by virtue of the formation of lanthanum compound containing phosphorous, as shown by an arrow in FIG. 1B. In FIG. 1B, the areas A and B correspond to those exhibited the intercrystalline rupture (softness rupture) of the nickel based matrix and the intercrystalline rupture of tungsten, respectively.

In cases of containing sulfur in an amount ranging from 50 ppm to 200 ppm, as shown in TABLE 2, results similar to those in cases of containing phosphorous were exhibited. That is, samples B2 and B3 according to the prior art exhibited greatly reduced impact property, while samples A3 to A5 which contained calcium of 0.01 wt % to 0.04 wt % or lanthanum of 0.3 wt % exhibited high impact property, by virtue of the formation of a calcium compound or lanthanum compound inhibiting the segregation of sulfur in their structures.

EXAMPLE 2

Figure 2:
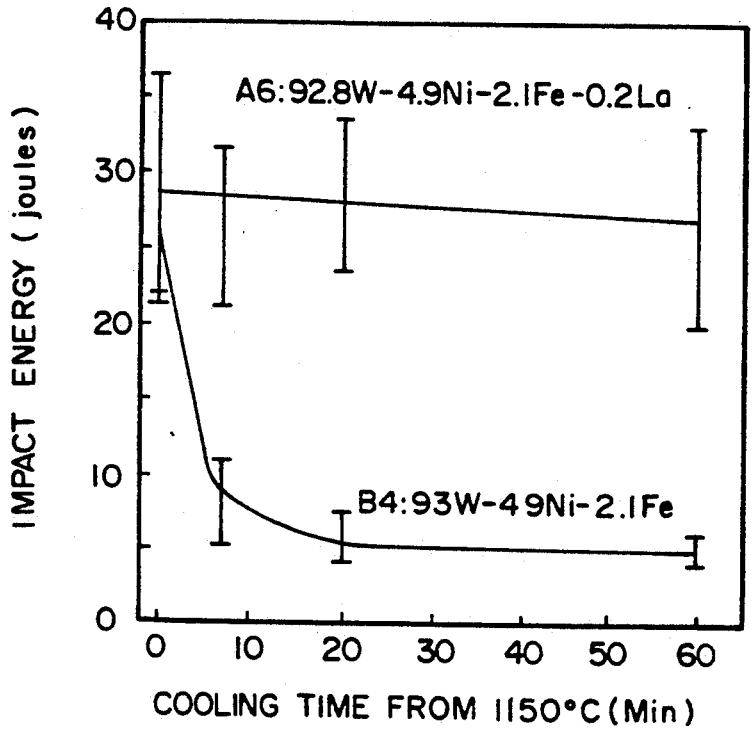
FIG. 2 is a graph showing the relationship between the cooling rate at a certain heat treatment temperature of 1,150° C. and the impact energy, with respect to heavy alloys according to the present invention and the prior art.

Raw powder was carefully prepared to obtain a powder mixture containing phosphorous in a very small amount, only 20 ppm. In order to determine effects of lanthanum or calcium contained in the powder mixture, various samples were obtained by sintering the powder mixture in the same method as in EXAMPLE 1. Thereafter, the samples were heat treated for an hour in an inert atmosphere of about 1,150° C. and then cooled at different cooling rates, respectively. After these heat treatments, the samples were subjected to a water cooling and then to an aging treatment which was carried out for an hour in an inert atmosphere of about 500° C. to about 600° C., so as to measure the variation in impact energy. The results are shown in FIG. 2. Also, the measured impact energy values are described in TABLE 3.

TABLE 3

(Impact energy (joules) of heavy alloys aged at a low temperature, after the water cooling at 1,150° C.)

| samples | composition (wt %) | Aging condition: 500° C. to 600° C., one hour | 500° C. to 600° C., one hour |
|---|---|---|---|
| A6 | 92.8 W - 4.9 Ni - 2.1 Fe - 0.2 La | 28.5 (±8) | 27 (±8) |
| A7 | 92.96 W - 4.9 Ni - 2.1 Fe - 0.04 La | 36 (±6) | 35 (±4) |
| B4 | 93 W - 4.9 Ni - 2.1 Fe | 25.8 (±9) | 6.8 (±4) |

In TABLE 3, samples A6 and A7 are heavy alloys in accordance with the present invention, while the sample B4 is a comparative conventional heavy alloy for comparing to those of the present invention.

After being subjected to a water cooling at the heat treatment temperature and then to a heat treatment at 600° C. for an hour, the conventional heavy alloy corresponding to the sample B4 exhibited abruptly reduced impact property, while heavy alloys of the present invention corresponding to the samples A6 and A7 containing lanthanum and calcium, respectively, exhibited high impact property.

As apparent from FIG. 2, a graph showing the relationship between the cooling time and the impact energy, with respect to heavy alloys containing phosphorous in a small amount of 20 ppm, the conventional heavy alloy, that is, the sample B4 exhibited increased segregation of phosphorous and thus abruptly reduced impact property, as the cooling time is increased. On the other hand, the heavy alloy of the present invention, that is, the sample A6 containing lanthanum of 0.1 wt % 0.3 wt % exhibited the hardly reduced impact energy.

Also, another heavy alloy of the present invention, that is, the sample A7 containing calcium of 0.04 wt % to 0.05 wt % exhibited the impact energy value of 38±6 joules under the condition of being subjected to a water cooling at 1,150° C. and the impact energy value of 33±6 joules under the condition of being subjected to a slow cooling for an hour.

These values were considerably higher than those of the conventional heavy alloy, that is, the sample B4. The sample B4 exhibited the impact energy value of 28.5±8 joules under the condition of being subjected to a water cooling and the impact energy value of 5.4±3 joules under the condition of being subjected to a slow cooling.

Although the preferred embodiments of the invention have been disclosed for illustrative purposes, those skilled in the art will appreciate that various modifications, additions and substitutions, are possible, without departing from the scope and spirit of the invention as disclosed in the accompanying claims.

What is claimed is:

1. A high toughness tungsten based heavy alloy comprising a W—Ni—Fe based composition containing at least 90 wt % tungsten, no more than about 10 wt % nickel and iron, and from about 0.01 wt % to 1.0 wt % lanthanum.

2. A high toughness tungsten based heavy alloy comprising a W—Ni—Fe based composition containing at least 90 wt % tungsten, no more than about 10 wt % nickel and iron, and from about 0.01 wt % to 0.3 wt % calcium.

3. A high toughness tungsten based heavy alloy according to claim 1, wherein said composition contains from about 0.1 wt % to 0.3 wt % lanthanum.

4. A high toughness tungsten based heavy alloy according to claim 2, wherein said composition contains from about 0.01 wt % to 0.05 wt % calcium.

* * * * *